US009264820B2

(12) United States Patent
He

(10) Patent No.: US 9,264,820 B2
(45) **Date of Patent: *Feb. 16, 2016**

(54) COIL

(71) Applicants: AAC Acoustic Technologies (Shenzhen) Co.,Ltd., Shenzhen (CN); AAC Microtech (Changzhou) Co.,Ltd., Changzhou (CN)

(72) Inventor: Jing He, Shenzhen (CN)

(73) Assignees: AAC ACOUSTIC TECHNOLOGIES (SHENZHEN) CO., LTD., Shenzhen (CN); AAC MICROTECH (CHANGZHOU) CO., LTD., Changzhou (CN)

( * ) Notice: Subject to any disclaimer, the term of this patent is extended or adjusted under 35 U.S.C. 154(b) by 129 days.

This patent is subject to a terminal disclaimer.

(21) Appl. No.: 13/858,315

(22) Filed: Apr. 8, 2013

(65) Prior Publication Data

US 2013/0266162 A1 Oct. 10, 2013

(30) Foreign Application Priority Data

Apr. 9, 2012 (CN) ..... 2012 2 0149746 U

(51) Int. Cl.
*H04R 25/00* (2006.01)

(52) U.S. Cl.
CPC ..... *H04R 25/00* (2013.01); *H04R 25/554* (2013.01); *H04R 2225/51* (2013.01)

(58) Field of Classification Search
CPC ..... H04R 25/00; H01F 5/003; H01F 17/0006; H01F 2017/006; H01F 27/2804; H01F 5/00
See application file for complete search history.

(56) References Cited

U.S. PATENT DOCUMENTS 5,537,482 A * 7/1996 Janning ..... 381/411
6,154,557 A * 11/2000 Montour et al. ..... 381/431

* cited by examiner

*Primary Examiner* — Duc Nguyen
*Assistant Examiner* — Taunya McCarty
(74) *Attorney, Agent, or Firm* — Anova Law Group, PLLC

(57) ABSTRACT

A coil for a transducer includes a pair of first sections, a second section connecting to two ends of the first sections, and a third section connecting the other two ends of the first sections for forming a closed loop. The third section includes a pair of first stretch parts each extending from one first section toward the other stretch part, and a first extruding part extending from the first stretch parts away from the second section. The present coil can optimize the performance of the speaker.

6 Claims, 2 Drawing Sheets

COIL

FIELD OF THE INVENTION

The present disclosure generally relates to the art of coils, more particularly to a hearing aid coil (HAC) used in a transducer for generating sound.

RELATED ART OF THE INVENTION

As the market of portable consumer electronic products growing, electronic devices like mini speaker are widely used, and speakers combining hearing aid function are more and more demanded by users who are hearing-impaired. Usually a hearing aid coil is mounted in a speaker and helps users wearing hearing aid hear sound by electromagnetic induction with audiphones. A coil is generally made by winding metal wire or laser etching.

General speakers are regular shaped like square or circle, but nowadays, shapes of speakers are tend to be irregular. A regular coil may adapt a speaker well when the speaker is also regular, but when the speaker has an irregular shape, the regular coil cannot adapt to the speaker and it will limit the size of the coil thereby limiting the performance of the speaker.

Accordingly, it is necessary to provide an improved coil for solving the problems mentioned above.

DETAILED DESCRIPTION OF THE EXEMPLARY EMBODIMENTS

Reference will now be made to describe two exemplary embodiments of the present disclosure in detail.

Embodiment 1

Figure 1:
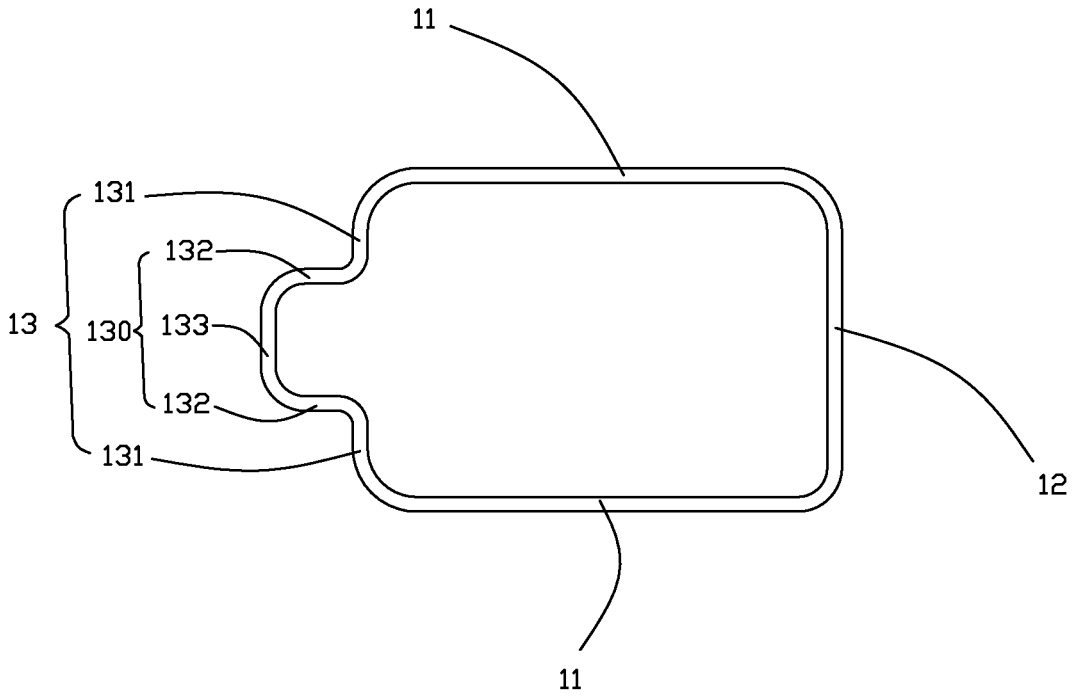
FIG. 1 is an illustrative top-view of a coil in accordance with a first exemplary embodiment of the present disclosure.

Referring to FIG. 1, a coil 1, in accordance with a first exemplary embodiment of the present disclosure, includes a pair of first sections 11, a second section 12 connecting to two ends of the first sections 11, and a third section 13 connecting the other two ends of the first sections 11 for forming a closed loop. One of the first sections 11 is substantially parallel to the other one, and the second section 12 is opposed to the third section 13. The third section 13 includes a pair of first parts 131 each extending from one first section 11 toward the other first part, and a first extruding part 130 extending from the first parts l3laway from the second section 12.

The first extruding part 130 includes a pair of second parts 132 each connecting perpendicularly from one of the first parts 131 away from the second section 12, and a first contact part 133 connecting both of the second stretch parts 132.

The first parts 131 are substantially perpendicular to the first sections 11, the second parts 132 are substantially parallel to the first sections 11, and the first contact part 133 is substantially parallel to the second section 12.

A length of the first contact part 133 is smaller than the distance between the two first sections 11, and a length of the first section 11 is smaller than the distance between the first contact part 133 and the second section 12.

Embodiment 2

Figure 2:
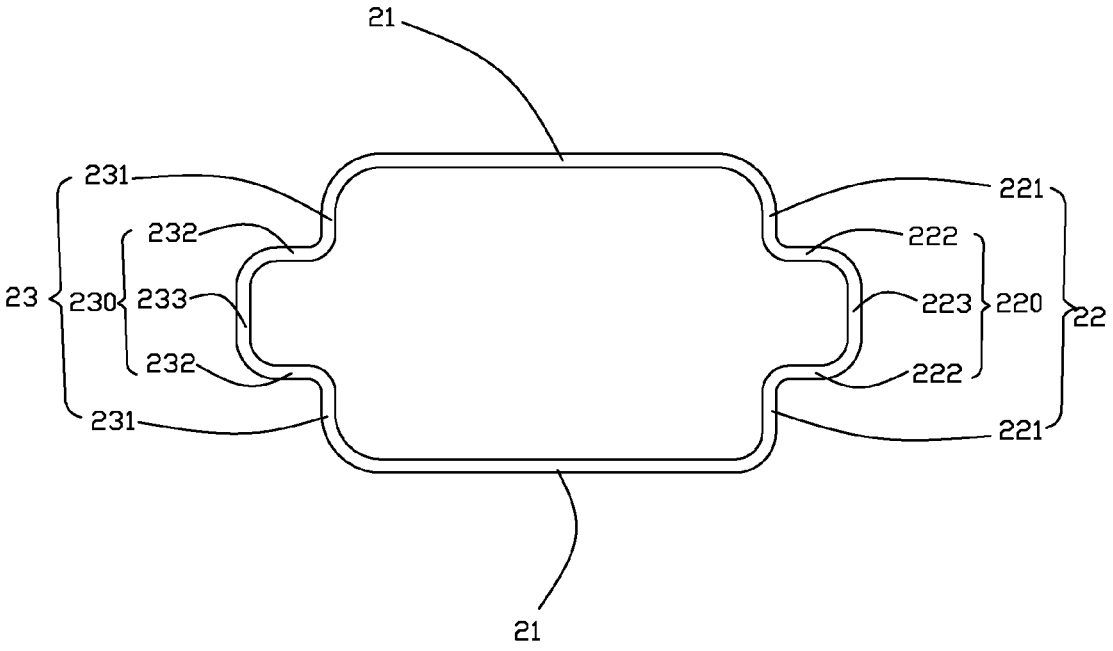
FIG. 2 is an illustrative top-view of a coil in accordance with a second exemplary embodiment of the present disclosure.

Referring to FIG. 2, a coil 2, in accordance with a second exemplary embodiment of the present disclosure, includes a pair of first sections 21, a second section 22 connecting to two ends of the first sections 21, and a third section 23 connecting the other two ends of the first sections 21 for forming a closed loop. One of the first sections 21 is substantially parallel to the other one, and the second section 22 is opposed to the third section 23. The third section 23 includes a pair of first parts 231 each extending from one first section 21 toward the other first part, and a first extruding part 230 extending from the first parts 23laway from the second section 22.

The first extruding part 230 includes a pair of second parts 232 each connecting perpendicularly from one of the first parts 231 away from the second section 22, and a first contact part 233 connecting both of the second parts 232.

The second section 22 includes a pair of third parts 221 each connecting from one first section 21 toward the other third part, and a second extruding part 220 extending from the third parts 221 away from the third section 23.

The second extruding part 220 includes a pair of fourth parts 222 each connecting perpendicularly from one of the third parts 221 away from the third section 23, and a second contact part 223 connecting both of the fourth parts 222.

The third parts 221 are substantially perpendicular to the first sections 21, the fourth parts 222 are substantially parallel to the first sections 21, and the second contact part 223 is substantially parallel to the first contact part 233.

A length of the second contact part 223 is smaller than the distance between the two first sections 21, and a length of the first section 21 is smaller than the distance between the first contact part 233 and the second contact part 223.

The coil 2 is a symmetric graphic.

When a speaker is irregular, coil 1 or coil 2 can adapt to the shape of the speaker, thereby optimizing the performance of the speaker.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A hearing aid induction coil, comprising:

a pair of first sections of windings of the hearing aid induction coil substantially parallel to each other;

a second section of windings of the hearing aid induction coil connecting to two ends of the first sections of windings of the hearing aid induction coil;

a third section of windings of the hearing aid induction coil connecting the other two ends of the first sections of windings of the hearing aid induction coil for forming a closed loop; wherein the third section of windings of the hearing aid induction coil includes a pair of first parts each extending from each first section toward the other first part, and a first extruding part extending from the first parts away from the second section of windings of the hearing aid induction coil; wherein, the first extruding part includes a pair of second parts, each connecting perpendicularly from one of the first part away from the second section of windings of the hearing aid induction coil, and a first-contact part connecting both of the second parts;

the first parts are substantially perpendicular to the first sections of windings of the hearing aid induction coil, the second parts are substantially parallel to the first sections of windings of the hearing aid induction coil, and the first contact part is substantially parallel to the second section of windings of the hearing aid induction coil.

2. The hearing aid induction coil as described in claim 1, wherein a length of the first contact part is smaller than the distance between the two first sections of windings of the hearing aid induction coil, and a length of the first sections is smaller than the distance between the first contact part and the second section of windings of the hearing aid induction coil.

3. The hearing aid induction coil as described in claim 1, wherein the second section of windings of the hearing aid induction coil, includes a pair of third parts, each connecting from each first section toward the other third part, and a second extruding part extending from the third parts away from the third section of windings of the hearing aid induction coil.

4. The hearing aid induction coil as described in claim 3, wherein the second extruding part includes a pair of fourth parts each connecting perpendicularly from one of the third parts away from the third section of windings of the hearing aid induction coil, and a second contact part connecting both of the fourth parts.

5. The hearing aid induction coil as described in claim 4, wherein the third parts are substantially perpendicular to the first sections of windings of the hearing aid induction coil, the fourth parts are substantially parallel to the first sections of windings of the hearing aid induction coil, and the second contact part is substantially parallel to the first contact part.

6. The hearing aid induction coil as described in claim 4, wherein a length of the second contact part is smaller than the distance between the two first sections of windings of the hearing aid induction coil, and a length of the first sections is smaller than the distance between the first contact part and the second contact part.

* * * * *